United States Patent [19]

Lange

[11] 4,139,982

[45] Feb. 20, 1979

[54] CHAIN WELDING MACHINE

[75] Inventor: Gerhard Lange, Reutlingen, Fed. Rep. of Germany

[73] Assignee: Wafios Maschinenfabrik, Wagner, Ficker & Schmid (GmbH & Co., KG), Reutlingen, Fed. Rep. of Germany

[21] Appl. No.: 839,391

[22] Filed: Oct. 4, 1977

[30] Foreign Application Priority Data

Oct. 9, 1976 [DE] Fed. Rep. of Germany ..... 2645719

[51] Int. Cl.[2] ..... B21L 3/02

[52] U.S. Cl. ..... 59/31; 219/51

[58] Field of Search ..... 59/31, 33, 34, 35; 219/51, 52

[56] References Cited

U.S. PATENT DOCUMENTS

| | | | |
|---|---|---|---|
| 2,288,494 | 6/1942 | Speed | 219/51 |
| 3,906,182 | 9/1975 | Lange | 219/51 |
| 3,906,183 | 9/1975 | Lange | 219/51 |

FOREIGN PATENT DOCUMENTS

| | | | |
|---|---|---|---|
| 2413309 | 2/1975 | Fed. Rep. of Germany | 219/51 |
| 2409833 | 4/1975 | Fed. Rep. of Germany | 219/51 |
| 2457180 | 10/1976 | Fed. Rep. of Germany | 219/51 |
| 2036244 | 12/1970 | France | 51/31 |
| 1405974 | 9/1975 | United Kingdom | 72/453.01 |

*Primary Examiner*—C.W. Lanham
*Assistant Examiner*—Gene P. Crosby
*Attorney, Agent, or Firm*—Wigman & Cohen

[57] ABSTRACT

This disclosure relates to a chain welding machine for the electric resistance pressure butt welding of a length of chain having interlinked chain links pre-bent into a C-shape. The machine comprises a pair of oppositely movable upsetting tools for engaging the opposite rounded ends of a chain link to be welded. A drive train is provided for each upsetting tool and one of the drive trains includes as an element thereof a single acting hydraulic cylinder. A hydraulic system for activating the cylinder includes a hydraulic pump connected via a feed line with the cylinder through a control valve, pressure regulating valve and check valve. The check valve is arranged to block flow of hydraulic fluid from the cylinder during a portion of the upsetting stroke of the machine and is unblocked by the control valve after termination of a welding cycle.

4 Claims, 4 Drawing Figures

CHAIN WELDING MACHINE

BACKGROUND OF THE INVENTION

The present invention relates to a chain welding machine for the electric resistance pressure butt welding of prebent, C-shaped links of a length of chain by means of two upsetting tools which sieze the chain link to be welded by its two rounded ends. The tools move at least relatively toward each other in opposite directions and with a drive train or loop which begins at a spring loaded cam gear and ends at a movable upsetting tool and includes a hydraulic cylinder as one of its gear elements.

In the case of a known chain welding machine of this general type disclosed in German Pat. No. 2,317,691, corresponding to U.S. Pat. No. 3,906,183, which, however, employs a fishplate as a rigid gear element instead of a hydraulic cylinder, the cam disk of the spring loaded cam gear is formed in such a way that, for a standard chain link to be welded, an ideal timing sequence is provided for the movement of the two upsetting tools before and during the welding. However, since the chain links of an unwelded length of chain are subject to flunctuations with regard to their accuracy of size and of shape due to bending errors and tolerances of the dimensions and ultimate stress values, more or less significant deviations are obtained during practical operation from this ideal timing sequence of the motion. After the preliminary stroke, preferably effected at a rapid rate, of the upsetting tools at the end of which the upsetting tools contact the two rounded ends of the chain link to be welded, there follows the first portion of the upsetting stroke, which can be called the joining stroke, at the end of which the ends of the wires of the chain link to be welded, which were still separated from each other after the preliminary stroke by a more or less large gap, contact each other with a joining pressure depending upon, for example, the length of the chain link and differing from the joining pressure determined for the standard chain link by being larger or smaller than the normal joining pressure to an extent as determined by the magnitude of the difference between chain link to chain link. Since lateral dislocations of the ends of the wires to be welded to form a welded chain link, i.e., misalignments, are not taken into consideration in this instance, the surface across which the ends of the wires to be welded will touch each other can be considered as being constant so that the term "joining pressure" can be replaced by the term "joining force."

The flunctuation of the actual joining pressure within an uncertain fluctuation width containing the normal joining pressure results in an undesired fluctuation of the electrical resistance which prevails at the point of the current passage from the one end of the wire to the other end of the wire of the chain link to be welded. The resistance variations, in their turn, lead to fluctuations in the intensity of the welding current and these again to fluctuations of the welding temperature obtained at the end of the constant welding time. However, if the welding temperature differs from chain link to chain link, then, as has been proven in practical operations, there cannot be obtained a consistently good weld and, consequently, a constantly high quality of the welded chain links. Therefore, in view of the dependence of the welding temperature on the joining pressure which the ends of the wires of the chain link to be welded exert on each other, it is of decisive importance that the joining pressure is adapted to the standard joining pressure and that it is maintained at a constant value from one chain link to another.

Therefore, the chain welding machine known, for example, from German Pat. No. 2,457,180 and being of the type mentioned above, has the task of providing a machine which, despite the irregularities in the characteristics of the chain links occurring from chain link to chain link of a length of chain, i.e, despite fluctuations, particularly, in the length of the link and in the width of the gap, is capable of manufacturing chains with uniformly welded and, therefore, high-quality chain links. In order to resolve this problem, German Pat. No. 2,457,180 proceeds from the general idea of favorably influencing the joining pressure with which the opposite wire ends of the chain link to be welded contact each other after the upsetting tools have effected their preliminary and joining strokes.

In German Pat. No. 2,457,180, the problem is solved by means of a buffer element variable in length in the train which, independently of its length, transfers an adjustable maximum pressure between the two adjacent gear elements in its longitudinal direction. This buffer element is the hydraulic cylinder mentioned in the introduction by means of which it is achieved that, when a minimum force is made available by the cam gear, a constant joining pressure prevails which is exerted by the two wire ends of the chain link to be welded upon each other independently of any abnormal characteristics the chain link to be welded may have, apart from misalignments. Therefore, the compensation of the path achieved by the hydraulic cylinder produces constantly equal initial conditions for the electrical resistance pressure butt welding so that chain links can be made which have uniformly good welds. Even if the compensation of the path accounts only for some tenths of a millimeter, it prevents large pressure differences which would have a detrimental effect for the actual welding. Another advantage of the hydraulic cylinder as a buffer element consists of the fact that even the heat expansion of the upsetting tools in the upsetting direction, produced by the previous weldings, can no longer influence the joining pressure with which the wire ends contact each other because compensation is also effected for such expansion.

Hydraulic butt welding machines are also known. However, they do not operate mechanically, in the narrow sense of this, but hydraulically so that the flow of power is essentially bound to the used liquid pressure medium while, in the case of the German Pat. No. 2,457,180, the flow of power passes through rigid machine parts and only a single element in the open train for the motion of the upsetting tools is temporarily non-rigid which, however, behaves as a rigid machine part during the upsetting after the joining of the wire ends of a chain link to be welded, and particularly during the final upsetting process which is characterized by high pressure so that there is no mechanical difference from the chain welding machine known from German Pat. No. 2,317,691.

On the basis of the machine mentioned above as known from German Pat. No. 2,457,180, it has been shown that new disadvantages occur owing to the insertion of a hydraulic cylinder as a buffer element, the cylinder and piston rod of which are connected to the two adjacent gear elements of the drive train. In the case of the known machine, the stroke volume of the hydraulic cylinder is actually connected through a piping with a pressure reservoir acting as a hydropneumatic spring which customarily consists of a casing of constant shape with a variable volume bellows arranged in the casing inside of which there prevails an almost constant liquid pressure and outside of which there prevails an essentially constant gas pressure which can be adjusted for the initial spring tension. The adjustment of the initial tension pressure is, in this instance, effected by changing the amount of the fluid or, preferably, the amount of the gas for which purpose auxiliary devices and measuring instruments are required. For their operation, actually for the adjustment of the joining pressure with which the opposite wire ends of the chain link to be welded are to contact each other, a period of time is required which is comparatively long. Additionally, it must be taken into consideration that the desired joining pressure is always slightly exceeded when approaching this pressure, despite the desired flat characteristic spring line of the pressure reservoir so that the excess to be expected must be considered when setting the desired joining pressure and which can only be done in a rough manner.

SUMMARY AND OBJECTS OF THE INVENTION

The present invention provides an improved solution to the problem posed and resolved in one way in German Pat. No. 2,457,180 by removing the aforementioned disadvantages and providing a chain welding machine of the kind described above which requires less maintenance and definitely maintains the given joining pressure. This problem has been solved by the invention by means of a check valve in a feed line between the piston of the hydraulic cylinder and its cylinder for a liquid pressure medium supplied by a hydraulic pump and by means of a pressure regulating valve in the feed line. The period of time required for the setting and reading of the pressure regulating valve is relatively short. Additional auxiliary devices and measuring instruments are not required. Furthermore, the pressure regulating valve and the check valve automatically provide that the maximum joining pressure set at the pressure regulating valve will not be exceeded under any circumstances. Moreover, the chain welding machine according to the invention requires only a single drive while the machine known from German Pat. No. 2,457,180 necessarily has two successively activated drives for a slide carrying the hydraulic cylinder. The present invention, therefore, considerably reduces constructional cost.

A preferred embodiment of the machine according to the invention is characterized by the fact that the hydraulic cylinder is designed as a single acting unit, that the check valve can be deblocked, that a deblocking servo valve spool is provided in the feed line and that the pressure regulating valve for the adjustment of the transferrable maximum pressure is arranged between the servo valve spool and the check valve.

The drive train of the machine known from German Pat. No. 2,457,180 has a slide carriage, movable by means of a cam gear, as a gear element which, by passing the cam gear, can be moved by means of an additional hydraulic cylinder for the purpose of upsetting the wire ends of the chain link to be welded toward each other. The preferred embodiment of the machine according to the invention also has a slide carriage which, however, can only be driven by the cam gear. Its drive train has, as has the machine known from German Pat. No. 2,317,691, a two lever arrangement hinged at the slide carriage as a gear element with an upsetting lever as a first lever. As a matter of expediency, the hydraulic cylinder serving as a buffer element is, in this instance, provided as the hinged second lever of the two lever arrangement. Thus, this element has replaced the fishplate of the machine known from German Pat. No. 2,317,691 which forms the second lever of the two lever arrangement. Therefore, available machines of the known design can easily be modified to the new design by replacing the fishplate with the hydraulic cylinder of a hydraulic installation known from German Pat. No. 2,457,180 which additionally only has a hydraulic pump, three valves and piping.

An additional toggle lever, not to be incorrectly considered as the two lever arrangement having an upsetting lever, in the case of the machine known from German Pat. No. 2,317,691, serves the purpose of having effected the strokes, i.e., the preliminary and the return strokes, of the upsetting tools and their upsetting strokes by means of separate driving devices in order to be thus able to perform an upsetting motion of the upsetting tools, this motion being in all phases exactly predetermined in time which constitutes another prerequisite for welding the wire ends of the chain links in a uniformly good quality manner. Consequently, the drive train of the preferred embodiment of the machine according to the invention has a toggle lever which can be bent and extended and the first shank of which is connected to the upsetting tool, the second shank of which is connected to the upsetting lever. This has the advantage that the buffer element, i.e., the hydraulic cylinder, is not also accelerated or delayed, respectively, at the beginning or at the end of the strokes of the upsetting tool because it is not contained in the drive train for guiding the upsetting tool to the rounded ends of the chain link in a rapid forward motion, but is contained in the driven train for the performance of the upsetting motion of the upsetting tool.

It is sufficient if, with a symmetrical machine design, there is one hydraulic cylinder as a buffer element because, in the case of the preferred embodiment of the machine according to the invention, the two drive trains have an initial and terminal element in common, i.e., the slide carriage or the chain link to be welded, respectively, for the movement of the two upsetting tools so that in both trains the same force is transferred according to the law of action equals reaction.

The invention is described in detail below by means of a preferred embodiment of the chain welding machine according to the invention represented in the drawings wherein:

DETAILED DESCRIPTION OF A PREFERRED EMBODIMENT

Figure 1:
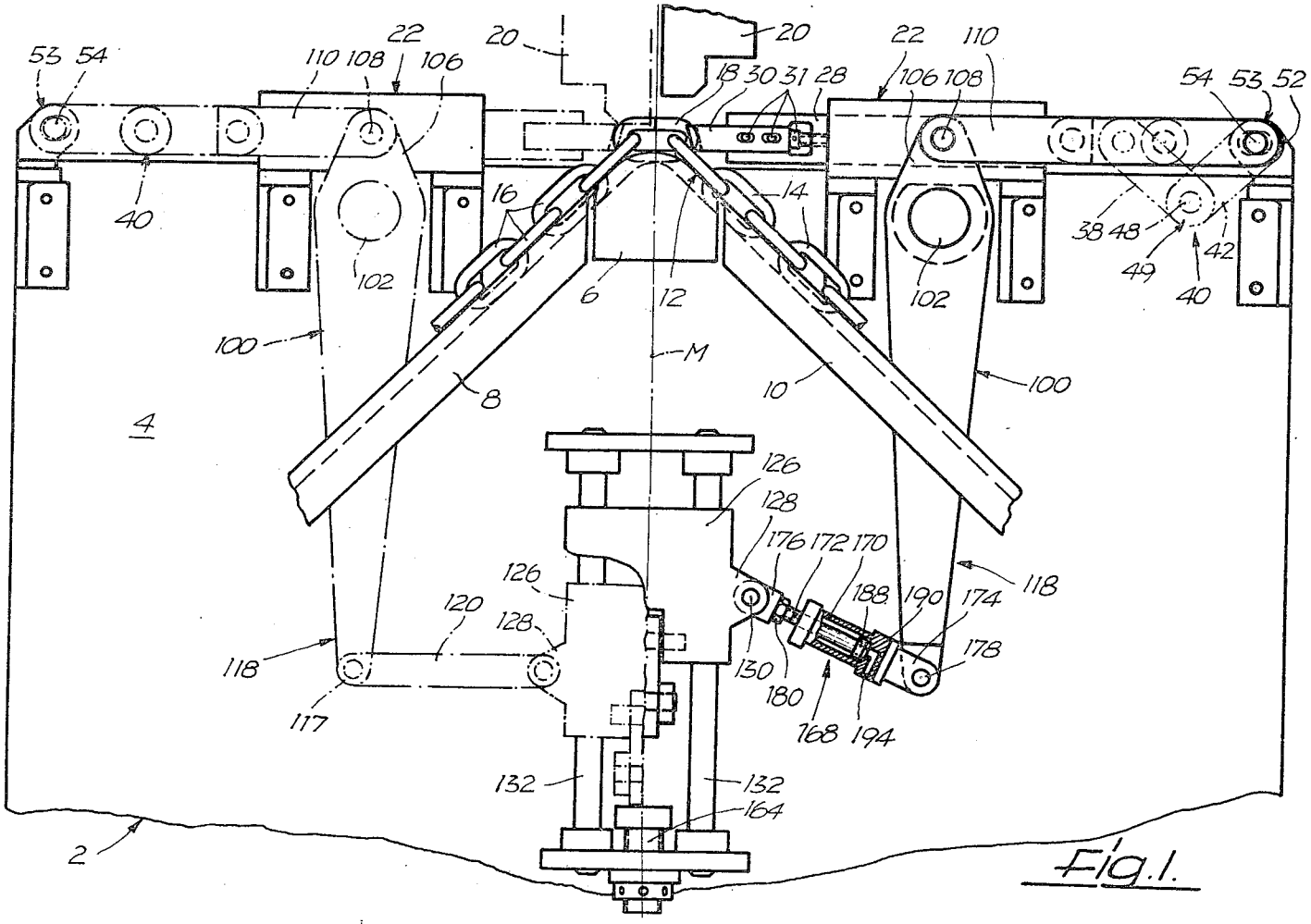
FIG. 1 is a broken front view of an embodiment of the invention, which owing to its symmetrical construction, is only partly illustrated and partially in schematic form.

The chain welding machine of the invention is essentially symmetrically designed with respect to the median plane M shown in FIG. 1. To the extent the symmetrical design exists, the description herein will only be directed to one half the machine. However, it is correspondingly applicable to the other machine half.

Figure 2:
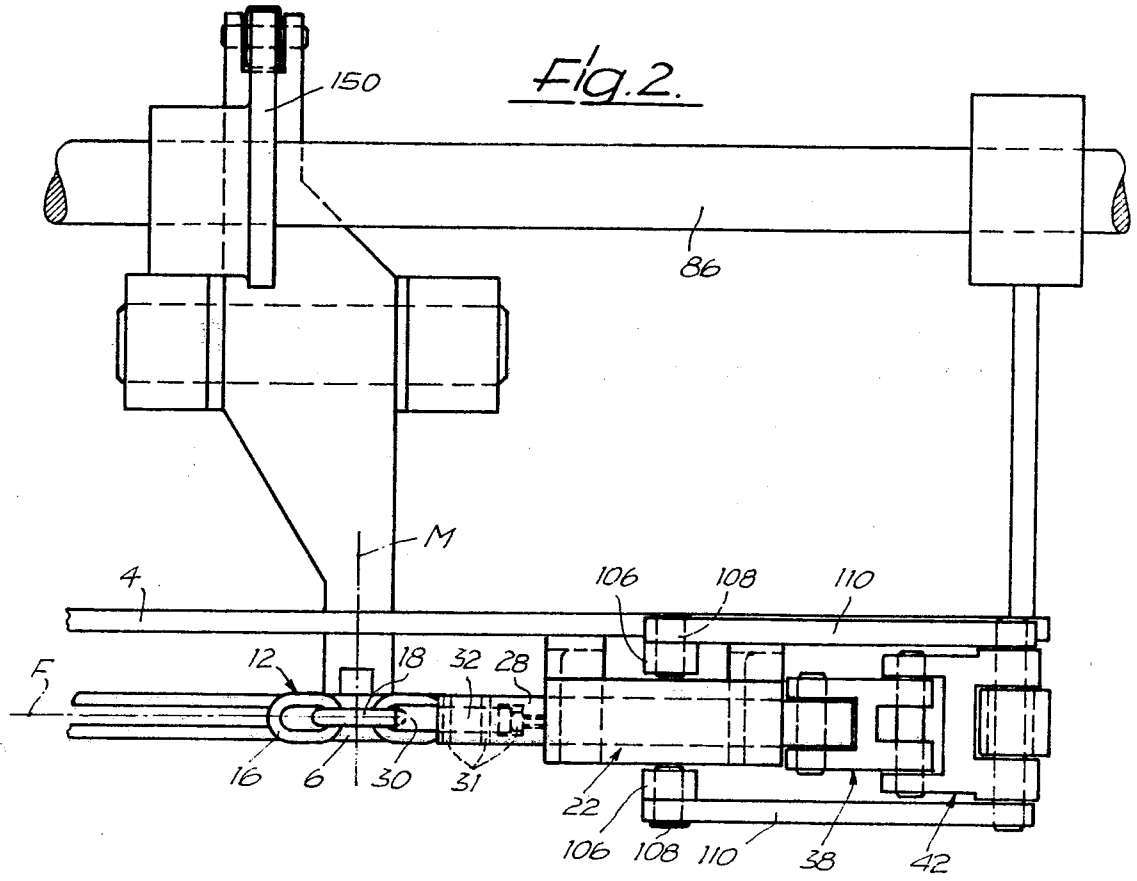
FIG. 2 is a broken top view of the embodiment of FIG. 1.

A structural frame 2 of the machine includes a vertical front plate 4, in front of the upper edge of which there is a stationary saddle 6 arranged symmetrically to the median plane M and to a vertical guide plane F (FIG. 2) which is vertically perpendicular to plane M. Extending from both sides of the saddle 6 and median plane M are guide rails 8 and 10 which are inclined downwardly away from plane M and approximately 45° vis-a-vis vertical and horizontal planes, for running-up and running-down respectively, of a chain length 12 which includes a number of already-welded chain links 14 and a number of yet to be welded chain links 16. A non-illustrated conveying device transports or shifts the chain length 12 by two chain link increments after the uppermost horizontal wire ends of the chain link 18 have been welded. Link 18 is located in the guide plane F on the saddle 6 by means of two welding electrodes 20. By reason of the shift of the chain by two chain links, the next chain link to be welded is in the described position of chain link 18 after having been transported to the top of saddle 6.

To one side of median plane M, a horizontal, straight guide 22 is arranged above each rail at the height of the chain link 18 and receives a tool carrier 28. At its forward end confronting the median plane M, each tool carrier 28 is provided with an upsetting tool 30, which is fastened to the carrier so as to be adjustable in the axial direction. Tool 30 is a so-called compression tool, which seizes the directly adjacent rounded end of the chain link 18 with its front, suitably formed end when the tool carrier 28 has completed a preliminary rapid forward stroke, which motion is followed by the joining and upsetting stroke. At the rearward end of the tool carrier 28, away from the upsetting tool 30, the shank 38 of an articulatable or bendable first toggle lever 40 is hinged, the second shank 42 of which forms a toggle joint 49 with the first shank 38 and is movably supported on the front plate 4 at its end located away from the toggle joint 49 by means of a hinge and thrust joint 53. A non-illustrated connecting rod, essentially located in the guide plane F, connects the toggle lever 40 with a non-illustrated form-locking cam gear and acts upon bolt 48 of the toggle joint 49. In this regard, reference is made to FIG. 3 of German Pat. No. 2,317,691, corresponding to U.S. Pat. No. 3,906,183.

The machine is provided with an upsetting lever 100 on each side of the median plane M which can be pivoted in a limited manner about an axis perpendicular to the guide plane F at a bolt 102 which is supported by the structural frame 2. Each upsetting lever 100 comprises two identical flat parts each having a short and a long arm, the short arms 106 being arranged on opposite sides of the guide 22 and being hinged, by means of a flange bolt 108, to a flat bar 110 arranged essentially parallel to the guide direction of the tool carrier 28. The flat bar 110 has its end away from the respective short arm 106 located on a pivot 54 of the hinge and thrust joint 53. The upsetting levers 100 form the first shanks of the two lever arrangements 118, one of which arrangements has only one passive joint 117. The second shank of said arrangement is designed as a fishplate 120 as shown on the left in FIG. 1. The fishplate 120 is hinged to a sliding carriage 126, common to both halves of the machine, at its end away from the joint 117. The sliding carriage 126 is guided along two parallel rods 132 arranged in the guide plane F and which are fastened to the structural frame 2.

Figure 3:
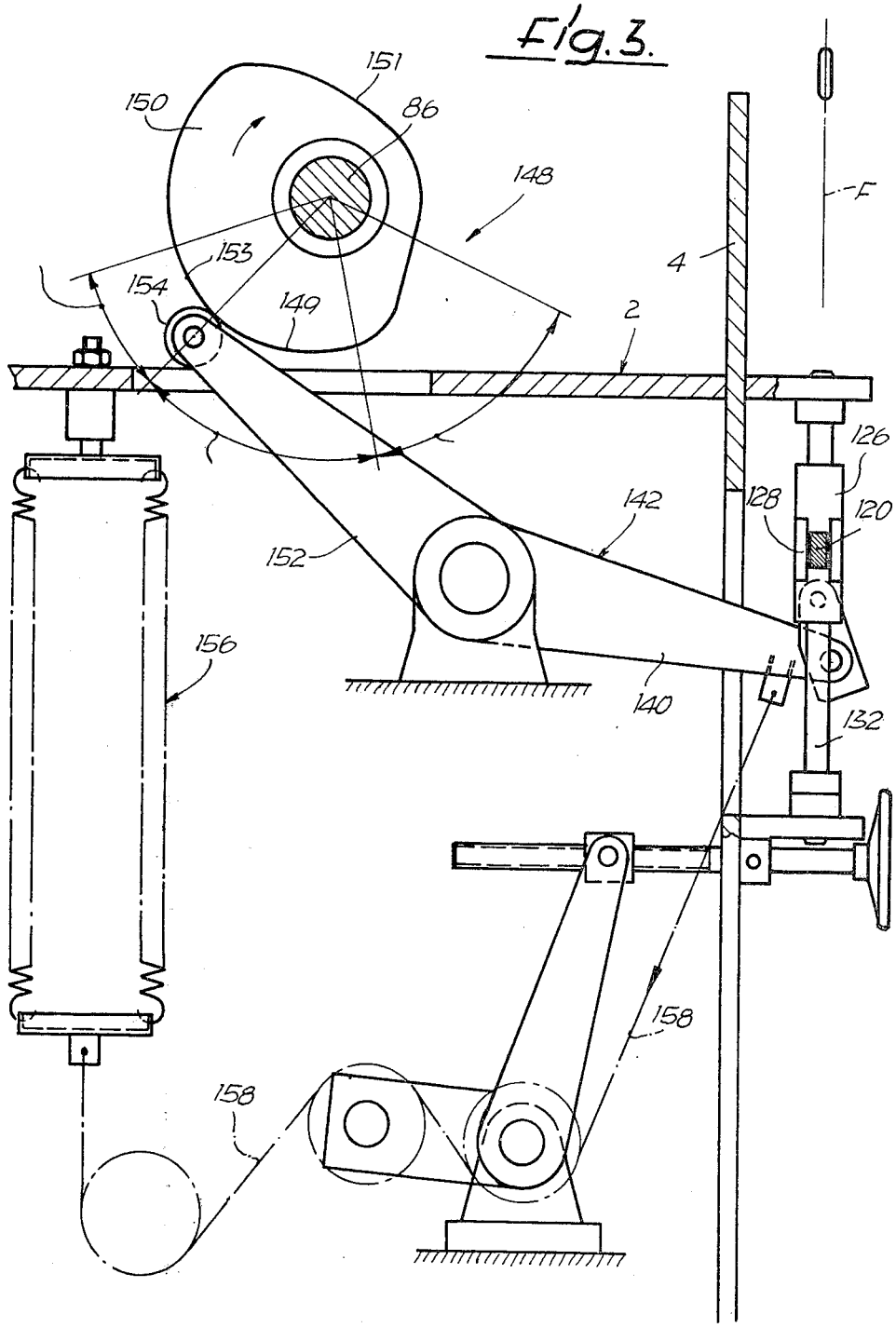
FIG. 3 is a partially schematic lateral view of the embodiment of FIG. 1.

Referring now to FIG. 3, the sliding carriage 126 is connected to the spring loaded arm 140 of a control lever 142 which is pivoted on the structural frame 2. The control lever 142 is part of a spring loaded cam gear 148 which forms the main part of the common driving device for the two upsetting levers 100. The cam gear 148 has a cam disk 150 arranged on a cam shaft 86 which interacts with a roller 154 rolling about the circumference of cam disk 150 and rollably supported on the bifurcated end of an automatically moved arm 152 of the control lever 142 and thus controls control lever 142 in a spring loaded manner. The spring force acting upon the arm 140 of the control lever 142 is produced by a spring bank 156 through a chain 158. In the case where the cam disk 150 does not or does not solely determine the minimum final distance between the upsetting tools 30, a locked adjusting screw 164 (FIG. 1) is provided, the head of which forms an abutment for the sliding carriage 126 when it is in its lowermost position. This results in an angle of the two lever arrangements 118 of less than 90°, i.e., the angle, for example, between the longitudinal axes of lever 100 and fishplate 120.

Figure 4:
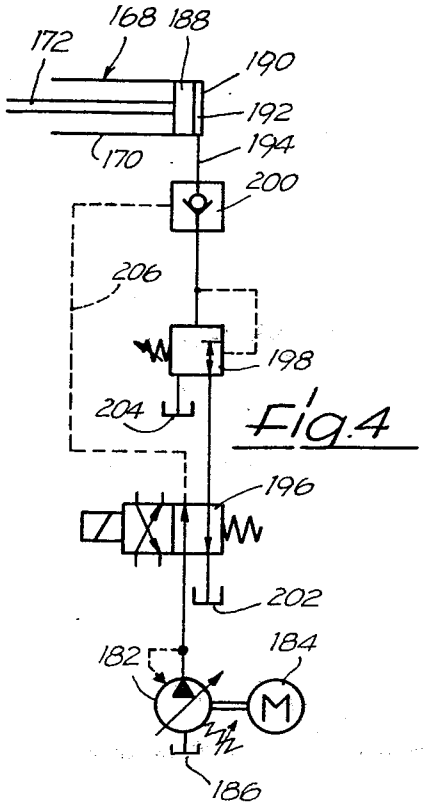
FIG. 4 is a schematic representation of the hydraulic installation of the invention in the rest position.

In the case of the machine half shown on the right in FIG. 1, instead of the fishplate 120 of the left two lever arrangement 118, a hydraulic cylinder 168 of the hydraulic system shown in FIG. 4 is provided as the second lever of the right-hand two lever arrangement 118 and serves as a variable length buffer element in a drive train means 126, 168, 100, 110, 40, 28 for moving the right upsetting tool 30. Independently of its length, hydraulic cylinder 168 transfers an adjustable maximum pressure in its longitudinal direction from one of the two adjacent gear elements to the other, in this case, represented by the right upsetting lever 100 and the slide carriage 126. Accordingly, the cylinder 170 and the piston rod 172 of the hydraulic cylinder 168 are hinged to these parts 100 or 126, respectively, in such a manner that the hydraulic cylinder 168 can be moved in the guide plane F in a translatory and rotational manner. Two bifurcated connecting heads 174 and 176 serve this purpose, the head 174 being fastened at a front side of the cylinder 170 and hinged at the lower end of the right upsetting lever 100 by means of a pivot 178. The head 176 is hinged to a projecting eye 128 of the slide carriage 126 by means of a pivot 130, but is supported in an adjustable manner at the free end of the piston rod 172. For this purpose, the head 176 and the piston rod 172 are screwed together and a counter-nut 180 is used to secure the screwed connection which determines the effective length of the piston rod. The hydraulic cylinder 168 could also be installed by being reversed 180°.

A hydraulic pump of the hydraulic installation according to FIG. 4 is designed as a variable capacity pump 182 with a feeding direction. Its displacement volume per revolution or up-and-down stroke is automatically controlled as a function of the pressure in a continuous manner. The variable capacity pump 182, which is driven by an electric motor 184, withdraws the liquid pressure medium from vented reservoir 186 via a piping terminating beneath the liquid level in the reservoir. The variable capacity pump 182 and the variable volume chamber 192 between the piston 188 of the hydraulic cylinder 168 and its cylinder end 190 are connected with each other by means of a multiple-interrupted feed line 194, control gate valve 196 adjacent the variable capacity pump 182, a pressure-reducing regulating valve 198 and, finally, by a check valve 200. The control gate valve 196 is a two-way acting valve with electromagnetic actuation and a return spring, which is shown in FIG. 4 in its forward position from which it can be switched to its rear position and which is connected with a vented reservoir 202 by means of piping terminating beneath the liquid level. The pressure regulating valve 198 has a discharge opening compensating for overloading and an adjustable spring and is also connected with a vented reservoir 204 by means of piping terminating beneath the liquid level. The check valve 200 is designed for remote control via a control line 206 from the control gate valve 196.

The method of operation of the described embodiment is as follows: At the beginning of the preliminary stroke of the two upsetting tools 30, the two toggle levers 40 are bent so that their two shanks 38 and 42 take the positions as shown in FIG. 1 on the right-hand side in dotted lines. Now the aforementioned form-locking cam gears for the actuation of the toggle joints 49 effect a very rapid extension of the two toggle levers 40 whereupon their shanks 38 and 42 take the positions as shown in FIG. 1 on the left-hand side in dotted lines. When the extended position has been reached by both toggle levers 40 in their rapid forward strokes, then the upsetting tools 30, which can be exchanged and adjusted according to the standard dimensions of the particular size and configuration of the chain link to be welded, bear against the rounded ends of the chain link 18. While the upsetting tools 30 perform the preliminary stroke, the spring bank 156 is initially stressed over a sector 151 of the cam disk 150. At the end of the preliminary stroke coinciding with the beginning of the joining stroke of the upsetting tools 30, when the latter actually contact the rounded ends of the chain links but do not yet upset them, the air gap between the wire ends of chain link 18 is not yet closed. The subsequent joining stroke of the upsetting tools 30 removes this gap which is effected passively, with extended toggle levers 40 owing to the two available open drive trains, by a concentric sector 153 of the cam disk 150 and also actively by the engaging movement of the hydraulic cylinder 168. Chamber 192 is then supplied with liquid pressure medium via the feed line 194 when the control gate valve 196, with the variable capacity pump 182 in operation, takes its rearmost position set for the transfer from the preliminary to the joining stroke or until the pressure medium collecting in the chamber 192 has reached a pressure which is of the same magnitude as the maximum pressure set at the pressure regulating valve 198. With the termination of the joining stroke, which coincides with the beginning of the actual upsetting stroke, the sliding carriage 126, the two lever arrangements 118 including the hydraulic cylinder 168, the flat rods 110, the two extended toggle levers 40, the two tool carriers 28, the two upsetting tools 30 and the chain link 18 form a closed drive train with a constant magnitude of force into which an additional force is introduced by means of the cam gear 148 through the sliding carriage 126. The two lever arrangement 118, shown in FIG. 1 on the right-hand side, acts henceforth in such a way as though its second lever, formed by the hydraulic cylinder 168, were a rigid body which corresponds to the fishplate 120. This behavior only requires the use of an incompressible fluid as a pressure medium and a reliable blocking condition of the check valve 200. With the completion of the joining stroke, the welding electrodes 20 are placed on the wire ends of the chain link 18 to be welded. At the beginning of the sector 149 following the sector 153 of the cam disk 150, the welding current is initiated and the upsetting tools 30 are gradually urged more forcefully against the chain link 18. When the welding current has been flowing for a minimum period of time and thus the welding temperature is reached, the final phase of the welding process occurs and is accompanied by the final upsetting process owing to the softening of the wire material, this final phase also being cam-controlled as is shown in FIG. 3. After the electrodes 20 are lifted off and the welding bead is sheared off by means of non-illustrated tools, the control gate valve 196 is reversed and thus brought into its forward position shown in FIG. 4 in which the variable capacity pump 182 supplies the pressure medium to unblock the check valve 200 so that the pressure medium runs back from the chamber 192 into the reservoir 202 which, for reasons of expediency, is identical with the reservoir 186. The return flow of the pressure medium is effected by the fact that the piston 188 of the hydraulic cylinder 168 moves toward the cylinder end 190 under the influence of a force attempting to shorten the unit. This force is produced, on the one hand, by the cam gear 148 and, on the other hand, by the welded and deburred chain link 18. Subsequently, the still extended toggle levers 40, effecting the transmission of force from the upsetting levers 109 to the upsetting tools 30, are again bent by their form-locking cam gears so that the upsetting tools 30 perform their return stroke rapidly and are then spaced at a distance from the chain link 18 which permits an easy continued transportation of the chain length 12. Thereafter, a new cycle of the same process is initiated.

The maximum pressure to be set at the pressure regulating valve 198 is selected in such a way that the gap of each unwelded chain link is positively closed and a certain joining pressure is produced with which the wire ends of the chain link to be welded contact each other.

Although only a preferred embodiment is specifically illustrated and described herein, it will be appreciated that many modifications and variations of the present invention are possible in light of the above teachings and within the purview of the appended claims without departing from the spirit and intended scope of the invention.

I claim:

1. A chain welding machine for the electric resistance pressure butt welding of a length of chain having interlinked chain links pre-bent into a C-shaped comprising a pair of upsetting tools arranged to move at least relatively toward each other in opposite directions for seizing a chain link to be welded, drive train means connected to at least one of said upsetting tools for applying a stroke to said one upsetting tool during a welding cycle, said drive train means including a hydraulic cylinder and means for actuating said hydraulic cylinder, said actuating means including a hydraulic pump connected via a feed line to said hydraulic cylinder for supplying a hydraulic fluid thereto, a pressure regulating valve in said feed line and a check valve in said feed line arranged to block the flow of hydraulic fluid from the hydraulic cylinder during at least a portion of the upsetting stroke of said one upsetting tool.

2. The machine according to claim 1, wherein said hydraulic cylinder is single acting and including a control gate valve arranged in said feed line between said hydraulic pump and said pressure regulating valve for unblocking said check valve after termination of said upsetting stroke.

3. The machine according to claim 1, wherein said drive train means includes a movable sliding carriage, cam gear means for moving said carriage, a two lever arrangement pivotally connected to said sliding carriage and having first and second levers, said first lever comprising an upsetting lever operatively connected to said one upsetting tool and said second lever comprising said hydraulic cylinder.

4. The machine according to claim 3, wherein said drive train means further includes a bendable and extensible toggle lever having first and second shanks, the first shank of said toggle lever being operatively connected to said one upsetting tool and said second shank of said toggle lever being connected to said upsetting lever.

* * * * *